United States Patent [19]

Jernberg

[11] Patent Number: 4,557,300

[45] Date of Patent: Dec. 10, 1985

[54] METHOD OF AND APPARATUS FOR FILLING PRESSURIZED FLUID CONTAINERS

[75] Inventor: Robert H. Jernberg, East Hampton, Conn.

[73] Assignee: Pressure Pak, Inc., East Hampton, Conn.

[21] Appl. No.: 576,936

[22] Filed: Feb. 6, 1984

[51] Int. Cl.[4] ..... B65B 3/04

[52] U.S. Cl. ..... 141/5; 141/59; 141/83; 141/95; 141/346; 62/55

[58] Field of Search ..... 141/1-12, 141/37-83, 387, 346-359, 285-310, 18-27, 382-386, 94-96; 62/50-55

[56] References Cited

U.S. PATENT DOCUMENTS

| | | | |
|---|---|---|---|
| 3,215,173 | 11/1965 | Rutherford | 141/83 |
| 3,913,635 | 10/1975 | Seals | 141/83 |
| 4,040,456 | 8/1977 | De Frees | 141/349 |

*Primary Examiner*—Houston S. Bell, Jr.

[57] ABSTRACT

A pressurized fluid container filling system is disclosed comprising a first support platform for supporting a plurality of pressurized fluid containers for evacuating, a vacuum supply assembly for connecting a vacuum source to the fluid containers supported on the first platform and having at least one supply line for connection to the container valves, a second support assembly for supporting a plurality of pressurized fluid containers for filling, a pressurized fluid assembly for supplying pressurized fluid to the containers supported on the second platform and having at least one supply line for connection to the container valves, and a valve-clamp assembly interconnecting a container valve to the vacuum and fluid-supply assemblies, the valve-clamp assembly having a quick-disconnect valve for rapid connection and disconnection to the fluid supply line and vacuum supply line to permit flow when connected to the supply line and to close off flow when disconnected from the supply line, a valve-seat assembly for press-sealing connection to the nozzle of a container valve, and a releasable clamp for clamping the nozzle of a container valve into sealing engagement with the valve-seat assembly.

25 Claims, 5 Drawing Figures

METHOD OF AND APPARATUS FOR FILLING PRESSURIZED FLUID CONTAINERS

BACKGROUND OF THE INVENTION

This invention relates to the filling of containers with pressurized fluid, and more particularly to a system and apparatus for automated filling of pressurized fluid containers.

Generally, the filling of pressurized fluid containers, such as cylinders for holding a liquified refrigerant gas, entails the exhausting of residual air from the cylinder to thereby create a vacuum condition within the cylinder and the supplying of pressurized fluid to the evacuated cylinders. The cylinders generally are provided with a manually operable valve. This valve includes a threaded nozzle which is employed for charging and discharging the cylinder.

In order to evacuate the cylinder the integral manually operable valve is opened and the cylinder is connected to a vacuum pump by a pipe or line having a threaded connector which mates with the valve nozzle. After the desired vacuum is attained in the cylinder, the cylinder valve is manually closed and the threaded connector is removed from the valve nozzle. The cylinder is then connected to a supply of pressurized fluid by a supply line also having a threaded connector for connection to the valve nozzle. After connection of the supply line to the valve nozzle, the cylinder valve is again manually opened to allow the flow of pressurized fluid into the cylinder. After the cylinder is filled to the desired amount, the cylinder valve is manually closed and the threaded connector of the supply line is removed from the valve nozzle. The filling operation will typically also include the manual operation of a flow control valve in the pressurized fluid supply line. As can be appreciated, the connection and disconnection of the vacuum and fluid supply lines to the integral cylinder valve and the repetitious opening and closing of this valve are undesirable labor-intensive time consuming operations. Further, there is a significant loss of gas to the ambient environment each time the pressurized fluid supply line is disconnected from the manually operable valve on the cylinder.

SUMMARY OF THE INVENTION

The present invention overcomes the above-discussed and other deficiencies and disadvantages of the prior art by providing a novel technique for the filling of containers with pressurized fluid. This invention also encompasses a pressurized fluid container filling system for use in the practice of the aforesaid novel technique and comprising a support platform for supporting a plurality of pressurized fluid containers during a filling operation, a pressurized fluid supply assembly for supplying pressurized fluid to the containers and having at least a supply line for connection to the flow control valve on each container, and a valve-clamp assembly for interconnecting the container valve to the fluid supply assembly. The valve-clamp assembly includes a quick-disconnect valve for rapid connection and disconnection to the fluid supply line to permit fluid flow when connected to the supply line and to close off fluid flow when disconnected from the supply line. The valve-clamp assembly also includes a valve seat subassembly and a releasable clamp for clamping the valve seat subassembly to the nozzle of a fluid container valve to thereby establish a fluid-tight connection therebetween.

It is an object of the present invention to provide an improved technique for filling pressurized fluid containers which is particularly suited for automated, assembly line operation.

Another object of the invention is to provide a filling system for pressurized fluid containers which is easily operated and maintained.

Yet another object of the invention is to provide an improved valve-clamp assembly, for use in an automated filling system, which permits rapid connection and disconnection of fluid supply lines while minimizing fluid loss.

A further object of the invention is to provide a valve-clamp assembly which is conducive to labor efficient handling of pressurized fluid containers during filling operations.

Other objects will be in part obvious and in part pointed out in more detail hereinafter.

DESCRIPTION OF THE PREFERRED EMBODIMENT

Figure 1:
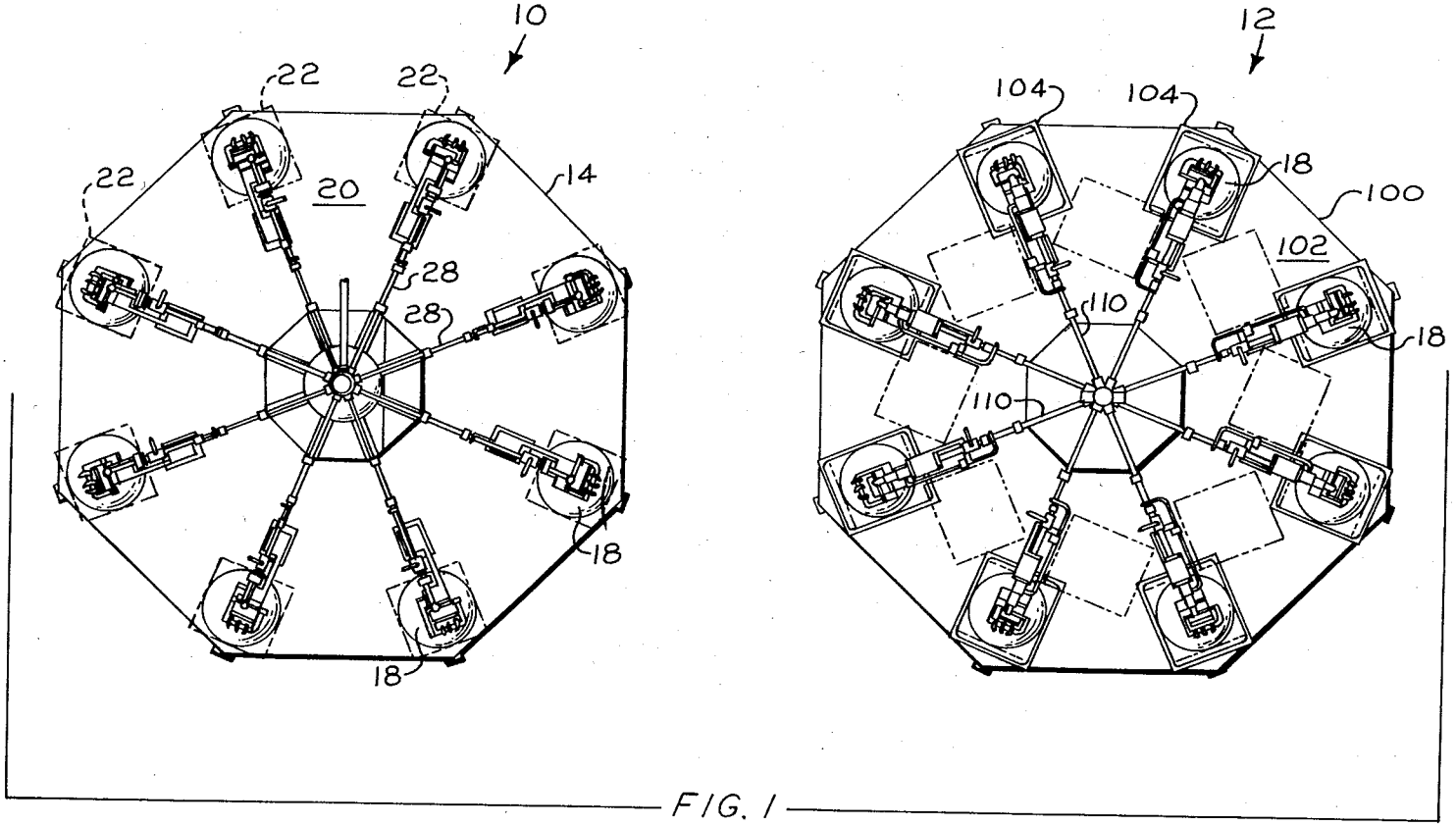
FIG. 1 is a diagrammatical top plan view of an automated filling system according to a first embodiment of the present invention.

Referring to FIG. 1, the automated pressurized fluid filling system of the present invention is shown comprising an evacuating platform assembly generally designated by the numeral 10 and a filling platform assembly generally designated by the numeral 12. Although the system and apparatus of the present invention is shown and described in the illustrated embodiment as an automated system for filling refrigerant cylinders, it is understood that the invention may be utilized for the filling of other types of pressurized fluid containers.

The evacuating platform assembly 12 comprises a support platform 14 mounted from a hub 16 (FIG. 2) for rotation in a horizontal plane while supporting a plurality of refrigerant cylinders 18. The upper support surface 20 of the platform 14 defines a plurality of angularly spaced evacuating stations 22 along the outer peripheral portion of the platform 14. Each evacuating station 22 is dimensioned and configured to support a single refrigerant cylinder 18 for evacuation. Since the structure and operation of the evacuating stations are identical, only one such station need be described in detail for purposes of explanation.

Figure 2:
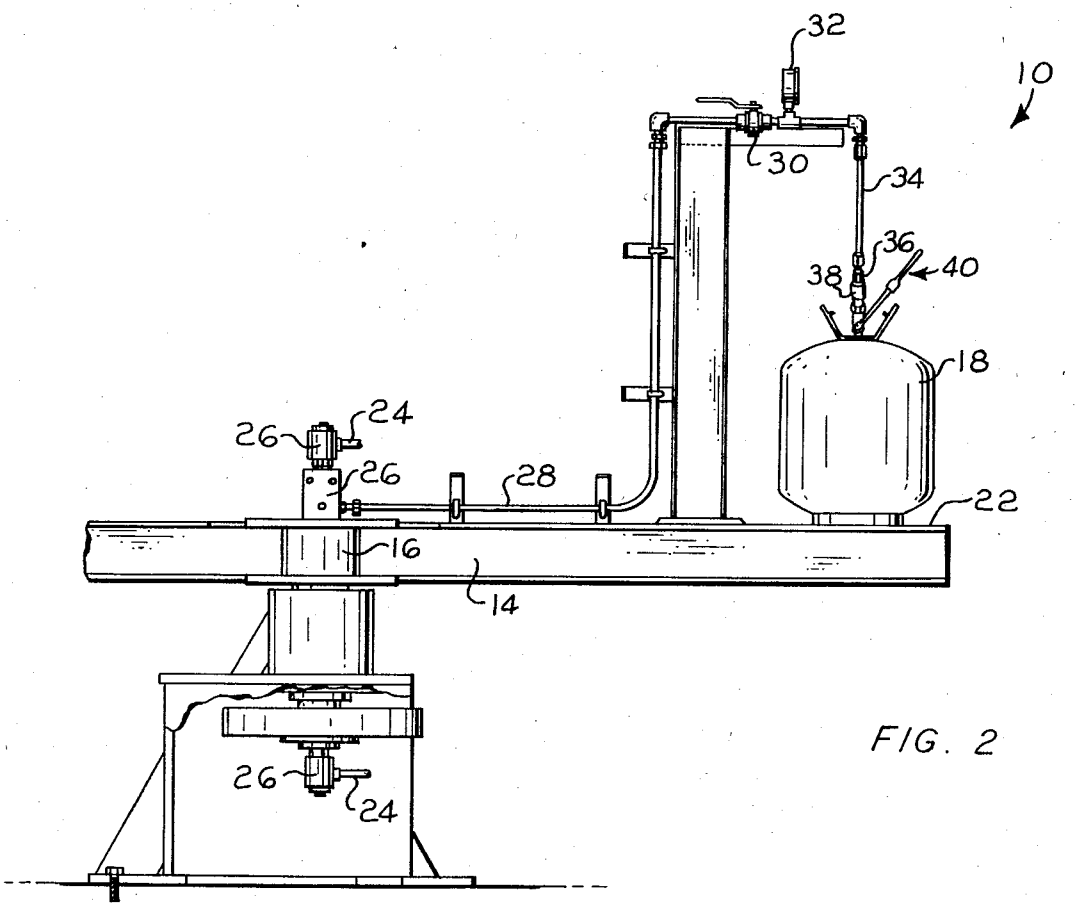
FIG. 2 is a partial front elevation view, partly broken away, of the evacuating platform assembly of the apparatus depicted in FIG. 1.
Figure 3:
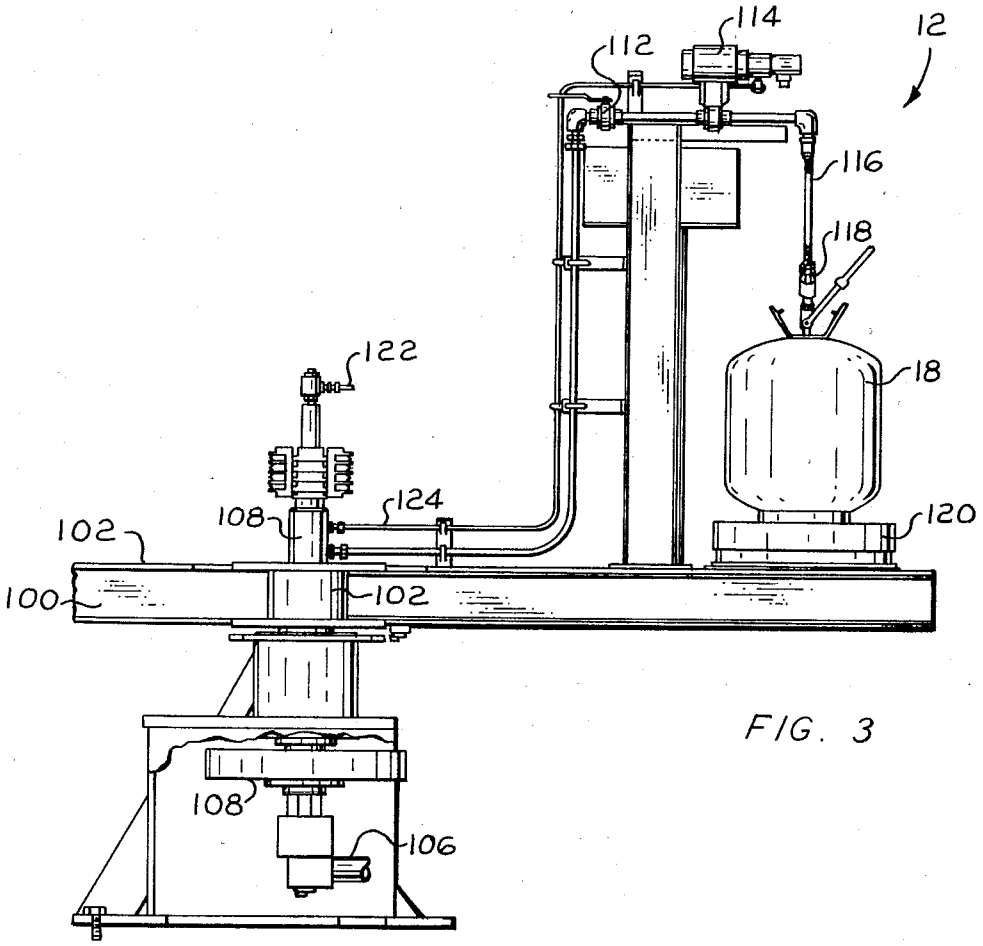
FIG. 3 is a view similar to FIG. 2 of a portion of the filling platform assembly of FIG. 1.

Referring to FIG. 2, two vacuum pumps (not shown) are connected respectively by conduits 24 to a pair of rotary connector or union assemblies 26 mounted above and below the center of the platform 14. A plurality of branch conduits 28 extend from the rotary connectors 26 to the evacuation stations 22. Each evacuation station 22 has a single branch conduit 28 for connection to a cylinder 18. Thus, the rotary connector functions to permit interconnection of each cylinder 18 supported at an evacuation station 22 with a vacuum pump during rotation of the platform 14. The supply lines of alternate evacuation stations are connected to different ones of the two vacuum pumps to compensate for the lag time in regaining the desired low pressure condition subsequent to disconnection of the conduits 28 from evacuated containers.

Each branch conduit 28 includes a manual shut off valve 30, a vacuum gauge 32 and a flexible segment 34 having a terminal connector 36. The terminal connector 36 is adapted for connection with the quick-disconnect valve 38 of a valve-clamp assembly generally designated by the numeral 40 and shown in FIG. 2 mounted to the valve 42 (FIGS. 4 and 5) of cylinder 18.

Figure 4:
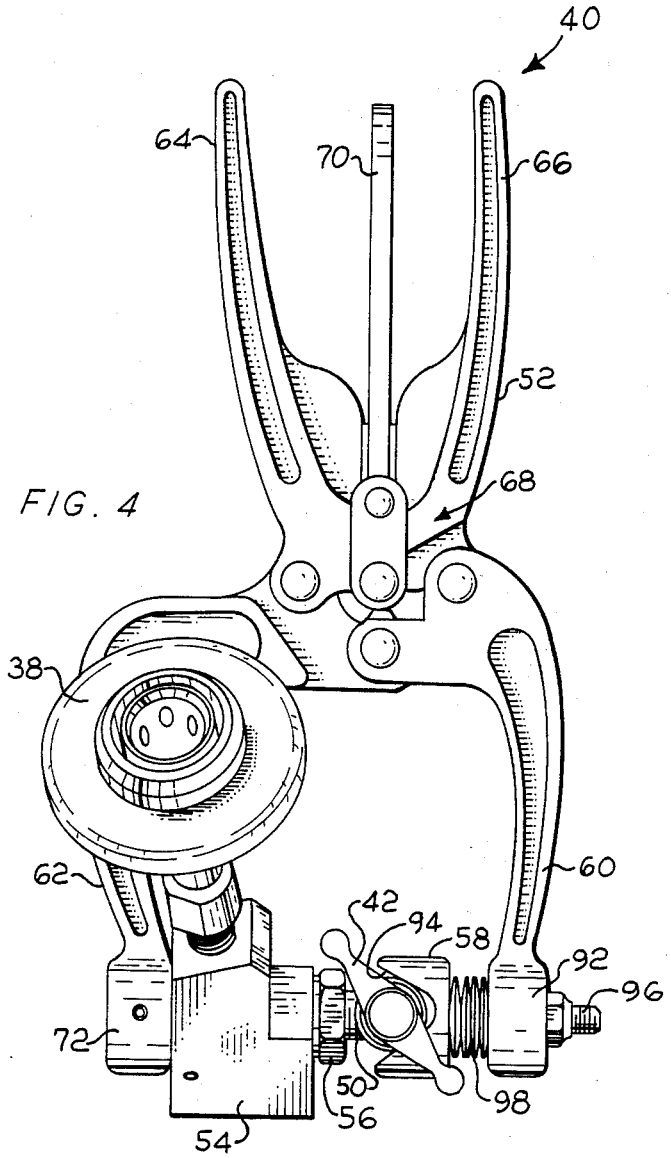
FIG. 4 is an enlarged perspective view of the valve-clamp assembly of the present invention in place on a cylinder.
Figure 5:
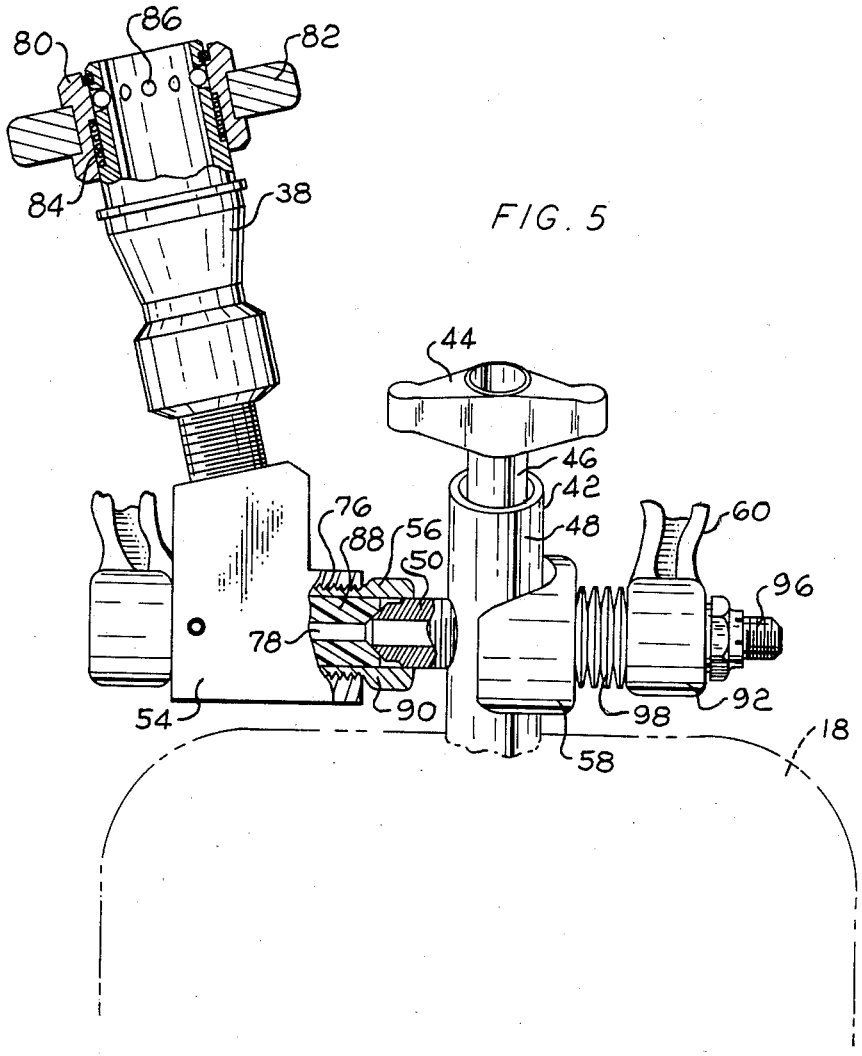
FIG. 5 is a partial sectional view of the valve-clamp assembly of FIG. 4.

As best shown in FIGS. 4 and 5, the valve-clamp assembly 40 mounts directly to the cylinder valve 42. The cylinder valve 42 is an inline manually operated flow control valve which is used for filling and discharging the cylinder tank 18. The cylinder valve 42 is generally permanently mounted to the top of the cylinder tank 18 and has a rotatable handle 44 connected to a valve stem 46 rotatably mounted within the valve body 48 for opening and closing a fluid flow path between the exterior and interior of the container through the threaded connector nozzle 50.

The valve-clamp assembly 40 comprises a releasable clamp 52, a connection block 54 having a valve seat subassembly 56, a quick-disconnect valve 38, and a retainer element 58.

The clamp 52 has a pair of pivotally connected clamp arms 60, 62 interconnected with handle elements 64, 66 by an overcenter linkage assembly 68. The clamp arms 60, 62 are pivotally movable between a convergent clamping position (as shown in FIG. 4) and a withdrawn releasing position. The overcenter linkage assembly 68 is of conventional design and functions to lock the clamp arms 60, 62 in a closed clamping position when the cylinder valve 42 is appropriately disposed therebetween. A release lever 70 functions to release the locking position of the overcenter linkage assembly in a conventional manner.

The connection block 54 is securely mounted to the distal end 72 of clamp arm 62 and is provided with a passage which functions to fluidly connect the valve seat 56 with the quick-disconnect valve 38. The connection block 54 has a threaded port 74 for mounting the disconnect valve 38 and a threaded port 76 for mounting the valve seat 56. The ports 74, 76 are fluidly connected by a bore 78.

The quick-disconnect valve 38 cooperates with the terminal connector 36 of supply line 28 and includes a quick-disconnect coupler 80 and an inline control valve (not shown). The coupler 80 comprises a slidably mounted collar 82 biased axially by a compression spring 84. The collar 82 is operationally connected to a plurality of circumferentially positioned roller detents 86 which interlock with the connector 36 to maintain the connection between the coupler 80 and the connector 36. To connect the connector 36 to the coupler 80, the collar 80 is depressed axially and the connector 36 is inserted within the coupler 80. Upon release of the collar 80, the compression spring 84 returns the collar 82 to its original position to lock the connector 36 within the coupler 80 and automatically open the valve 38 to permit fluid flow therethrough. Upon removal of the terminal connector 36 from the coupler 80, the valve 38 automatically closes to prevent fluid flow. Thus, the connection and disconnection of the valve 38 to the supply line 28 involves only the depression of collar 82, the insertion of terminal connector 36 into coupler 80 and the release of collar 82. Other types of quick-disconnect valve assemblies may be utilized although it is preferred that such assemblies provide quick and easy connection and disconnection with automatic flow control.

The valve seat subassembly 56 comprises an annular seal 88 mounted within a seal housing in the form of a bushing 90. The bushing 90 has a nozzle receiving aperture adjacent the seal 88 and is threadably mounted within the port 76 so that the nozzle receiving aperture faces the retainer element 58 on the distal end 92 of the clamp arm 60. The annular seal 88 is dimensioned and configured for press-seal connection to the threaded nozzle 50 of the cylinder 42 thereby eliminating the need for a threaded connection to the nozzle 50. The annular seal 88 is preferably comprised of "Teflon" or a similar material and, being subject to wear, it is easily replaceable in bushing 90.

The retainer element 58 has a V-shaped recess 94 facing the bushing 90 on the distal end 72 of clamp arm 62 for retentively engaging the cylindrical body 48 of cylinder valve 42. The retainer element 58 is mounted to a shaft 96 slidably mounted to the distal end 92 of the clamp arm 60. A set of spring biasing washers 98, such as those known as belleville washers, biases the retainer element 58 towards the valve seat 56 as shown in FIG. 4. The biasing force exerted by the washers 98 is relatively constant and does not vary with a change in distance between the retainer element 58 and the distal end 92. Accordingly, a constant biasing force is maintained even though the annular seal 88 may wear during use.

To attach the valve-clamp assembly 40 to cylinder valve 42, the handle elements are moved apart to pivot the clamp arms 60, 62 to the open position. The clamp arms 60, 62 are disposed about the cylinder valve 42 so that the valve nozzle 50 is inserted with the aperture of the bushing 56 and the cylindrical valve body 48 is in alignment with the V-shaped recess 94 of the retainer element 58. The handles 64, 66 are squeezed together to cuase the clamp arms 60, 62 to converge to a clamping portion thereby tightly gripping the cylinder valve 42 between the retainer element 58 and the valve seat 56. The overcenter linkage 68 locks the clamp 52 in the closed clamping position. In this position, the cylinder valve 42 is in fluid communication with the disconnect valve 38 via the connection block 54. Importantly, the valve-clamp assembly is intended to remain on the particular cylinder during the entire filling operation. By leaving the valve-clamp assembly 40 attached to the cylinder 18 throughout the entire filling operation from evacuation to filling, the cylinder 18 is quickly and easily connectable first to the vacuum supply line and then to the fluid supply line as explained in more detail hereinafter.

Referring again to FIG. 1, the filling platform assembly 12 comprises a support platform 100 mounted from a hub 102 for rotation in a horizontal plane while supporting a plurality of cylinders 18. The platform 100 is configured similarly to platform 14 with an upper support surface 102 defining a plurality of filling stations 104 angularly disposed about the outer pheripheral portion of the platform 100. Each filling station is dimensioned and configured to support a single cylinder for filling. Since the structure and operation of the filling stations are identical, only one need be described for purposes of explanation.

A source of pressurized fluid (not shown) is connected by a pipe 106 to a rotary connector or union 108 mounted to the platform support 100. A plurality of fluid supply lines 110 connect the filling stations 104 to the rotary connector 108 in a manner similar to the evacuation platform assembly 10. Each supply line 110 includes a manual shut off valve 112, a solenoid controlled pneumatically actuated ball control valve 114, and a flexible segment 116 terminating in a terminal connector 118 identical to terminal connector 36.

Each filling station 34 has a platform-type electronic scale with digital readout for weighing the cylinders 18. The scales are of conventional design and have an electronic control to set the desired fill weight and include a zero button for canceling out the tare weight prior to introduction of liquified gas. The control valve 114 includes an electrically actuated pilot valve assembly and the scale 120 is operationally connected to the pivot-valve assembly so as to actuate the control valve 114 when the desired content of the cylinder 18 is sensed by the scale 120. The control valve 114 is pneumatically operated and is connected to a source of pressurized air (not shown) by interconnected air lines 122 and 124. The valve 114 is spring loaded for fail-safe actuation to a closed position.

In operation, the rotary platforms 14, 100 are rotated at a predetermined angular speed as, for example, one-half R.P.M. for the filling operation. In the illustrated embodiment, eight evacuating stations 22 are defined on the evacuating platform 14 and eight filling stations are defined on the filling platform 100 so that the filling system of the present invention is contemporaneously evacuating eight cylinders and filling another eight cylinders (previously evacuated). The number of stations provided and/or utilized is dependent upon production requirements. Since the evacuation and filling operations are identical at the respective stations, the entire filling operation of only one cylinder need be described.

Initially, the cylinder valve 42 is manually opened. With the cylinder valve in the open state, the valve-clamp assembly 40 is securely and quickly attached thereto. The cylinder 18 is then positioned at an evacuating station 22 and the vacuum supply line 28 is connected to the cylinder 18 by the quick-disconnect valve 38 of the valve-clamp assembly 40. As the platform 14 rotates, the vacuum pump is creating a vacuum within the cylinder 18. When the desired vacuum is attained therein as indicated by the vacuum gauge 32, the collar 82 is depressed to allow removal of the terminal connector 36 to disconnect the cylinder 18 from the vacuum supply line 28. The disconnect valve 38 automatically a closes upon removal of the terminal connector 36 to maintain the vacuum condition within the cylinder 18.

The cylinder 18 is then conveyed to a filling station 104 and positioned upon the scale 120. The system operator quickly connects the cylinder 18 to the fluid supply line 124 by means of the quick-disconnect valve 38 and presses the zero button on the scale 120 to cancel out the tare weight. The valve 114 is automatically actuated upon zeroing of the scale so that the cylinder 18 will be filled as it rotates with the platform 100. As the cylinder is being filled, the valve 114 is actuated by the scale 120 to shut off the flow of fluid when the desired fluid weight in the cylinder has been attained. To accomodate response delays in the system, the valve 114 is actuated at a predetermined interval prior to full weight in the cylinder so that the cylinder is accurately filled to the desired weight. At the designated unload station adjacent the platform 100, the system operator is able to read the weight of each cylinder on a digital readout display. The cylinder is then disconnected from the fluid supply line 124 by the quick-disconnect valve 38 and removed from the platform 100. The valve 38 automatically prevents any loss of fluid from the tank 18 while a similar automatic valve within the terminal connector 118 prevents a loss of pressurized fluid from the flexible segment 116 into the work space. The cylinder valve 42 is then manually closed and the valve-clamp assembly is removed from the filled cylinder.

Accordingly, the automated fluid filling system of the present invention provides automated continous assembly line filling of refrigerant or other cylinders. The evacuating and filling assemblies 10, 12 provide easy fail-safe operation. If the proper vacuum is not achieved at any of the evacuating stations, the station can be isolated by the manual shut-off valve 30. On the filling platform assembly 12, if the operator fails to push the zero button to cancel the tare weight, the cylinder in that station will not be filled. If there is a power loss or a loss of shop air, all stations on the platform assembly 12 will automatically shut off preventing any overfill. Additionally, all filling stations 104 have a manual shut-off valve 112 to shut down such a station without affecting operation of the remaining stations. For ease of maintenance, all ball valves can be repaired in place without disturbing piping. Valve inserts may be replaced in a matter of minutes thereby minimizing down time.

Thus, it can be seen that an improved filling system for continuous rapid filling of pressurized fluid containers is provided which is particularly well suited for automated assembly line operation. An improved valve-clamp assembly is also provided which permits rapid connection and disconnection of fluid supply lines and fluid containers in a labor efficient manner without fluid loss.

As will be apparent to persons skilled in the art, various modifications and adaptations of the structure above described will become readily apparent without departure from the spirit and scope of the invention, the scope of which is defined in the appended claims.

I claim:

1. A valve-clamp for employment in the filling of a container with pressurized fluid, the container having an integral flow control valve assembly mounted thereon, said integral flow control valve assembly having a body with a conduit extending therefrom, said valve-clamp comprising:

seat defining means for cooperating with the conduit of a container flow control valve to establish a fluid-tight connection thereto, said seat defining means including a fluid flow passage which is in communication with the interior of the conduit when the connection is established;

quick-disconnect valve means for selectively establishing a fluid flow path from a fluid supply line, said valve means being mounted on said seat defining means and operating to permit fluid flow through said seat defining means passage when connected to a fluid supply line and to prevent fluid flow through said seat defining means passage when disconnected from a fluid supply line; and releasable clamp means for engaging the exterior of a container flow control valve body, said clamp means clamping the conduit extending from the body of a container flow control valve to said seat defining means so as to establish a fluid-tight connection therebetween, said clamp means being affixed to said seat defining means.

2. The apparatus of claim 1 wherein said clamp means comprises:

first and second interconnected clamp arms having opposed distal clamping ends, said arms being movably interconnected for relative movement of said distal ends between a divergent released position and a convergent clamping position, said distal end of said first arm having means for engaging the body of a container flow control valve, said distal end of said second arm extending from said seat defining means whereby a container flow control valve may be clamped between said engaging means and said seat defining means to establish said fluid-tight connection between said seat defining means and the container flow control valve conduit extension when said distal ends are in the clamping position; and handle means for moving said clamp arm distal ends between said release and clamping positions and releasably locking said distal ends in said clamping position.

3. The apparatus of claim 2 wherein said engaging means comprises an engagement member having a recess adapted to engage the body of a container flow control valve, said engagement member being mounted to said distal end of said first arm with said recess facing said seat defining means.

4. The apparatus of claim 3 wherein said clamp means further comprises:

means for resiliently biasing said engagement member toward said seat defining means when a container flow control valve is clamped between said engagement member and seat defining means.

5. The apparatus of claim 2 wherein said handle means comprises:

first and second handle elements; and overcenter linkage means for interconnecting said handle elements to said clamp arms, said linkage means retaining said arms in a clamped position when a container flow control valve is disposed between said engaging means and said seat defining means and said distal ends of said clamp arms are in the clamping position.

6. The apparatus of claim 5 wherein said overcenter linkage means includes lever means for releasing said clamp arms from said clamping position.

7. The apparatus of claim 2 wherein said seat defining means comprises:

a housing mechanically connected to said distal end of said second clamp arm, said housing being provided with an aperture positioned and sized to receive the conduit extending from a container flow control valve body; and an annular seal insert mounted within said housing aperture and being adapted to sealingly engage the conduit extension of a container flow control valve body.

8. The apparatus of claim 7 wherein said housing includes a connection block which defines said fluid flow passage, said fluid flow passage extending between said housing aperture and a flow port, said quick-disconnect valve means being mounted to said block so as to establish a fluid connection with said fluid flow passage via said port.

9. The apparatus of claim 1 wherein said seat defining means comprises:

a housing mechanically connected to said distal end of said second clamp arm, said housing being provided with an aperture positioned and sized to receive the conduit extending from a container flow control valve body; and an annular seal insert mounted within said housing aperture and being adapted to sealingly engage the conduit extension of a container flow control valve body.

10. The apparatus of claim 9 wherein said housing includes a connection block which defines said fluid flow passage, said fluid flow passage extending between said housing aperture and a flow port, said quick-disconnect valve means being mounted to said block so as to establish a fluid connection with said fluid flow passage via said port.

11. The apparatus of claim 1 wherein said quick-disconnect valve means comprises:

a quick-disconnect coupling adapted to receive and establish a leak-tight connection to a fluid supply line having a complementary coupling on the end thereof; and a normally closed in-line flow control valve adapted for actuation to an open condition upon connection of said coupling to a fluid supply line.

12. A system for filling containers with pressurized fluid, the containers having integral flow control valve assemblies mounted thereon, said integral flow control valve assemblies each having a body and a conduit extending therefrom, said system comprising:

means for supporting a plurality of containers during the filling thereof with pressurized fluid;

means for supplying fluid under pressure, said supply means having at least a first supply line with a connector on the discharge end thereof; and a valve-clamp assembly for interconnecting the flow control valve of a container to said pressurized fluid supply means supply line, said valve-clamp assembly including:

seat defining means for cooperating with the conduit of a container flow control valve to establish a fluid-tight connection thereto, said seat defining means including a fluid flow passage which is in communication with the interior of the conduit when the connection is established;

quick-disconnect valve means for selectively establishing a fluid flow path from a fluid supply line, said valve means being mounted on said seat defining means and operating to permit fluid flow through said seat defining means passage when connected to a fluid supply line and to prevent fluid flow through said seat defining means passage when disconnected from a fluid supply line; and releasable clamp means for engaging the exterior of a container flow control valve body, said clamp means clamping the conduit extending from the body of a container flow control valve to said seat defining means so as to establish a fluid-tight connection therebetween, said clamp means being affixed to said seat defining means.

13. The apparatus of claim 12 further comprising:

scale means mounted on said support means for weighing fluid containers positioned thereon during the filling thereof with pressurized fluid, said scale means having means for selecting a desired filled container weight, said scale means providing control signals commensurate with empty and filled containers; and control valve means for alternately permitting and interrupting the flow of fluid through said supply means supply line, said control valve means being responsive to said scale means generated control signals whereby the flow of fluid through said supply line will be interrupted when a container positioned on said support means has been filled to the desired weight.

14. The apparatus of claim 12 wherein said support means comprises:

a rotatable support platform for supporting a plurality of fluid containers; and wherein said fluid supply means comprises:

a plurality of supply lines, each of said supply lines being provided with a connector on the discharge end thereof for cooperating with a valve-clamp assembly; and rotatable union means mounted on said support platform for interconnecting a source of pressurized fluid with said plurality of supply lines.

15. The apparatus of claim 14 further comprising:

scale means mounted on said support means for weighing fluid containers positioned thereon during the filling thereof with pressurized fluid, said scale means having means for selecting a desired filled container weight, said scale means providing control signals commensurate with empty and filled containers; and control valve means for alternately permitting and interrupting the flow of fluid through said supply means supply line, said control valve means being responsive to said scale means generated control signals whereby the flow of fluid through said supply line will be interrupted when a container positioned on said support means has been filled to the desired weight.

16. The apparatus of claim 12 wherein said support means comprises:

a rotatable support platform for supporting a plurality of fluid containers, said platform defining a plurality of angularly spaced filling stations with each station adapted to receive and support a single container; and wherein said fluid supply means comprises:

a plurality of supply lines, each of said supply lines being provided with a connector on the discharge end thereof for cooperating with a valve-clamp assembly; and rotatable union means mounted on said support platform for interconnecting a source of pressurized fluid with said plurality of supply lines.

17. The apparatus of claim 16 further comprising:

scale means mounted on said support means for weighing fluid containers positioned thereon during the filling thereof with pressurized fluid, said scale means having means for selecting a desired filled container weight, said scale means providing control signals commensurate with empty and filled containers; and control valve means for alternately permitting and interrupting the flow of fluid through said supply means supply line, said control valve means being responsive to said scale means generated control signals whereby the flow of fluid through said supply line will be interrupted when a container positioned on said support means has been filled to the desired weight.

18. The apparatus of claim 17 wherein each of said control valve means comprises a spring loaded, pneumatically operated valve.

19. The apparatus of claim 17 wherein said fluid supplying means further comprises:

in-line check valve means positioned in each of said supply lines adjacent the connectors thereon, said in-line valve means interrupting the flow of fluid through the supply line upon disconnection of the supply line from a valve-clamp assembly.

20. The apparatus of claim 17 further comprising:

a second rotatable support platform for supporting a plurality of containers, said second platform defining a plurality of angularly spaced container stations with each station adapted to support a single container to be evacuated; and means for evacuating fluid containers, said evacuating means being in part mounted on said second platform and having a plurality of vacuum supply lines and rotary connector means for interconnecting a low pressure source to said plurality of vacuum supply lines, each of said supply lines being provided with a connector at its free end, said connectors being adapted for cooperation with said quick-disconnect valve means of a valve-clamp assembly, one of said vacuum supply lines extending to each of said stations on said second platform.

21. The apparatus of claim 20 wherein said vacuum supply means further comprises:

vacuum gauge means connected to each of said vacuum supply lines for indicating the pressure in a container connected to the supply line via a valve-clamp assembly.

22. A method for the filling of pressure vessels with pressurized fluid, the pressure vessels being provided with integral flow control valve assemblies, said flow control valve asemblies including a housing and a conduit extending therefrom, said method comprising the steps of:

operating the pressure vessel flow control valves to the open state;

mounting quick-disconnect valve clamps on the pressure vessel flow-control valves to establish a fluid-tight connection between the conduit extending from the housing of the flow control valves and a normally closed valve disposed in the quick-disconnect valve clamp;

connecting a source of low pressure to the quick-disconnect valve clamps and simultaneously opening the normally closed valve therein whereby the pressure vessels will be evacuated;

disconnecting the vacuum supply from the quick-disconnect valve assemblies when the desired low pressure condition has been established within the pressure vessels and simultaneously closing the valve in said quick-disconnect valve assemblies whereby the established low-pressure condition in the pressure vessels will be maintained;

connecting a source of pressurized fluid to the quick-disconnect valve assemblies and simultaneously reopening the valves in the quick-disconnect valve assemblies whereby the pressure vessel will be filled with pressurized fluid;

disconnecting the pressurized fluid supply from the quick-disconnect valve assemblies and simultaneously closing the valves in the quick-disconnect valve assemblies after the pressure vessels have been filled to the desired degree with pressurized fluid, the closing of the valves in said quick-disconnect valve assemblies maintaining the pressurized fluid in the pressure vessels;

closing the pressure vessel integral flow-control valves; and dismounting the quick-disconnect valve clamps from the pressure vessel valve bodies.

23. The method of claim 22 wherein a plurality of pressure vessels are simultaneously evacuated.

24. The method of claim 23 wherein a plurality of pressure vessels are simultaneously filled.

25. The method of claim 24 further comprising the steps of:

weighing the pressure vessels during the filling thereof with pressurized fluid; and discontinuing the filling of individual pressurized vessels when the weight thereof reaches a predetermined level.

* * * * *